US008460160B2

(12) United States Patent
Andrews

(10) Patent No.: US 8,460,160 B2
(45) Date of Patent: Jun. 11, 2013

(54) YOGA WRIST SAVER DEVICE

(75) Inventor: Elizabeth M. Andrews, Flossmoor, IL (US)

(73) Assignee: Stick-E Products, LLC, Flossmoor, IL (US)

( * ) Notice: Subject to any disclaimer, the term of this patent is extended or adjusted under 35 U.S.C. 154(b) by 0 days.

(21) Appl. No.: 12/815,874

(22) Filed: Jun. 15, 2010

(65) Prior Publication Data

US 2011/0053739 A1 Mar. 3, 2011

Related U.S. Application Data

(60) Provisional application No. 61/213,556, filed on Jun. 19, 2009.

(51) Int. Cl.
*A63B 21/00* (2006.01)

(52) U.S. Cl.
USPC ..... 482/49; 482/44

(58) Field of Classification Search
USPC ..... 482/49, 44, 104–108; 62/457.2, 62/457.3; 401/282, 286
See application file for complete search history.

(56) References Cited

U.S. PATENT DOCUMENTS

| | | | | | |
|---|---|---|---|---|---|
| 792,278 | A * | 6/1905 | Mccarthy | 401/205 |
| 2,765,593 | A * | 10/1956 | Salmon et al. | 451/518 |
| 4,351,525 | A * | 9/1982 | Rozenblad | 482/141 |
| 4,711,445 | A * | 12/1987 | Whitehead | 482/49 |
| D328,374 | S * | 7/1992 | Goin | D32/45 |
| D332,841 | S * | 1/1993 | Levison | D28/63 |
| 5,222,331 | A * | 6/1993 | Manor et al. | 451/524 |
| D406,486 | S * | 3/1999 | Ogilvie | D6/596 |
| D426,690 | S * | 6/2000 | Sakai | D32/43 |
| 6,644,063 | B2 * | 11/2003 | Mogil | 62/457.2 |
| 6,652,421 | B1 * | 11/2003 | Chen | 482/49 |
| 6,793,434 | B1 * | 9/2004 | Olson | 401/286 |
| D554,312 | S * | 10/2007 | Schaepers et al. | D28/63 |
| D610,753 | S * | 2/2010 | Moskowitz | D30/158 |

* cited by examiner

*Primary Examiner* — Jerome W Donnelly
(74) *Attorney, Agent, or Firm* — Michael Best & Friedrich LLP

(57) ABSTRACT

An attractive wrist saver device with an elastomeric body and an adjustable strap is provided for decreasing stress and strain of a user's wrist joint by elevating a heel of a user's hand and lessening the amount and degree of an extension of a user's wrist so as to comfort and cushion the user's wrist and substantially prevent the user's wrist from being positioned at a 90 degree right angle and perpendicular to the user's forearm and hand when the user is performing yoga, pushups, hand stands, dips or other upper body weight bearing exercises.

12 Claims, 4 Drawing Sheets

100
102
104
106
108
112
118
126
128
133
135
138
142
143
144
146
148
150
152

YOGA WRIST SAVER DEVICE

BACKGROUND OF THE INVENTION

This invention relates to sports accessories and exercise equipment, and more particularly, to a wrist saver device for use in yoga, pushups, hand stands, dips and other upper body weight bearing exercises.

Yoga can be useful for exercise, cardiovascular workout, improving flexibility, increasing strength and endurance, relieving hypertension, improving physical health and well being and for physical, mental and medical therapy. According to a market study, 6.1 percent, or nearly 14 million Americans, indicate that a doctor or therapist has recommended yoga to them. Also, nearly 45% of all adults agree that yoga would be beneficial if they were undergoing treatment for a medical condition. Yoga as medicine represents the next great yoga wave. In the future, we expect to see a lot more yoga in health care settings and more yoga recommended by the medical community as new research shows that yoga is a valuable therapeutic tool for many health conditions.

Yoga has become very popular. According to a Yoga Journal survey 49.4% of yoga participants are over the age of 35 with 18.4% of those over the age of 55. This more mature demographic often have less range of motion in their wrists, making a 90 degree right angle or perpendicular position between the hand and forearm difficult and painful.

It is not uncommon for people to experience wrist problems and pain when doing weight bearing exercises, such as pushups or yoga poses (asanas), such as sun salutations, planks, crane poses, etc. Indeed, many people when doing yoga or other weight bearing exercises experience pain in their wrist joint. Typically, the user's hands are at a 90 degree angle right or perpendicular to their forearm when doing weight bearing exercises on the hands, such as with traditional pushups. This can put excess stress on the wrist joints causing pain for many people.

Almost every yoga class includes people who complain of wrist problems. Perhaps their difficulties began with long hours at a computer keyboard or with a hard fall on an outstretched hand or even with doing asanas. Whatever the cause, the problem can be exacerbated by bearing weight on their hands in yoga. Yet such weight bearing is a very important part of asana practice.

Most people, who have had a wrist problem, know how much it can interfere with yoga. Wrist injuries can be especially demoralizing if the yoga exerciser (yogi) prefer a vinyasa-based style, in which the weight of the hands are placed over and over again as the exerciser performs and flows through the classic Sun Salutation series, which includes plank pose, chaturanga dandasana, i.e. four-limbed staff pose, urdhva mukha svanasan, i.e. an upward-facing dog pose, and adho mukha sanasana, i.e. a downward-facing dog pose.

Weight bearing on the arms seems to bring out the wrist's vulnerability since the wrist is a relatively small joint with delicate tissues that are packed into this small area. The wrist tissues include ligaments that knit the wrist bones together, as well as tendons that connect the forearm muscles to the fingers and help give the fingers their dexterity. Strain or irritation in tendons in the wrist can be a major factor in wrist pain.

To understand what causes wrist pain, it is useful to consider the structure and function of a normal wrist. The wrist helps with control of the fine motor activities of the fingers and thumb by positioning and stabilizing the hand, which allows the hand to accomplish various tasks, such as writing, drawing, sewing, etc. Most of the wrist's movement occurs at the juncture of the radius, i.e. one of the two forearm bones, and several of the carpal bones, which are located and sit deep in the heel of the hand. Some movement also occurs at the junctures between the individual carpal bones.

The movements of the wrist include abduction, i.e. bending the thumb side of the hand toward the thumb side of the forearm, adduction, i.e. bending the little-finger side of the hand toward the little-finger side of the forearm, flexion, and extension. In yoga, by far the most important of these and probably the one most likely to bring a person grief is extension.

To feel wrist movement, one can sit in a chair with armrests and position their forearms on an armrest, with their palms facing the floor. By cocking their hand up and pointing their fingers toward the ceiling, their wrists are now in extension. If the hands drape over the end of the armrest and the fingers point toward the floor, their wrist will be in flexion.

Many people spend time every day with their wrists in mild extension. The hand has its most powerful grip in this alignment and this position is the one people use most often in their daily activities. The wrists of most people spend very little time in full flexion or full extension.

Since the wrist, like any joint, will lose any part of its range of motion that isn't used regularly, most people gradually lose their ability to move easily and safely into full wrist extension, i.e. a 90 degree right angle and perpendicular to the hand and forearm.

When a person does a yoga pose in which they bear most or all of their weight on their hands, their wrists becomes extended. Many of the yoga positions require the yoga practitioner to balance their wrists, which can sometime cause sharp pain. Several of the postures in sun salutation, i.e. plank, chaturanga dandasana, urdhva mukha svanasan, require full extension, so performing the series over and over, can put a cumulatively heavy load, stress and strain on the wrists. Arm balances, such as bakasana, i.e. crane pose, and adho mukha vrksasana i.e. handstand, can aggravate the problem, as well as stress and strain on the wrist by pressing all of their body weight into their wrists while they are fully extended. Combining extreme range of motion with a heavy load and multiple repetitions can increase wrist strain. Under such conditions, it is not surprising that the wrists of the person (exerciser) become painful. A substantial part of yoga practitioners' wrist pain can be caused by soft-tissue strain that occurs when the ligaments and tendons are forced into extension beyond their customary range.

Many yoga enthusiasts (yogis) are finding that their wrists often can't hold up to the weight bearing poses that are an integral part of yoga. This occurs because in most daily activities people rarely have their wrists in the full extension position, i.e. when the back of the hand is 90 degrees from the forearm as when they are performing pushups and supporting their body weight in this position. As a result, over time people lose their full range of motion.

Yoga has often been cited as the panacea by yogis for overcoming all sorts of life's ailments including joint pain. However, for many yogis whose wrists are more use to a computer keyboard then a sun salutation, wrist pain is often the first twist they encounter when starting a yoga regimen. Many people doing yoga or other weight bearing exercises complain of wrist pain.

Working up a sweat is great for cardiovascular health, but not when it makes their hands slip and slide on the mat or the floor.

Carpal tunnel syndrome is a fairly common, painful condition caused when the narrow tunnel formed by the carpal bones and adjacent ligaments puts pressure on the median nerve and finger flexor tendons that pass through the tunnel.

Various accessories, equipment and devices have been developed or suggested over the years to alleviate or eliminate the preceding problems. However, most of these prior art conventional accessories, equipment and devices are cumbersome, difficult to use, not practical, and have been unsuccessful in alleviating and eliminating these problems.

It is, therefore, desirable to provide a wrist saver device, which overcomes most, if not all, of the preceding disadvantages.

BRIEF SUMMARY OF THE INVENTION

A unique wrist saver device is provided for decreasing stress and strain of a user's wrist joint by elevating the heel of a user's hand and lessening the amount and degree of an extension of a user's wrist so as to comfort and cushion the user's wrist and substantially prevent the user's wrist from being positioned at a 90 right degree angle and perpendicular to the user's forearm when performing yoga, pushups, hand stands, dips or other upper body weight bearing exercises. Advantageously, the user friendly wrist saver device is comfortable, economical, and effective. The attractive wrist save device is also safe, dependable, light weight, fun and beneficial to help avoid stress, stain and wrist injuries. The wrist saver device reduces the stress of weight bearing exercises on the user's wrist when doing yoga poses, pilate poses, pushups, etc.

After experiencing this pain herself and hearing the complaint from many yogis at tradeshows, the inventor, decided to invent and design a practical solution. The inventor realized that minimizing the degree of wrist extension, spreading the weight load over a larger portion of the hand, and providing a thick foam support would minimize wrist discomfort, stress and strain. The wrist saver device comprises a new workout tool that provides a slip-proof grip while also supporting the user's wrists. Its internal cushioning provides comfort and firm protection, helps guard the wrists from injuries, and elevates the heel of the hands thereby decreasing extension and alleviating pressure on the wrist joints so that the user can perform a painless push-up or plank position. Wrist saver devices address wrist pain associated with upper body weight bearing exercises such as pushups and downward dog in yoga. The one size-fits-all wrist saver device provides wrist support and feels virtually weightless.

The wrist saver device can comprise a body with a top having a palm-facing surface for supporting and lifting a palm of a user's hand and can have a bottom with a bottom surface for facing a mat, floor, ground or other support surface. Desirably, the wrist saver device has at least one securing member operatively associated with the body for securing the top of the body against the palm of the user's hand. The securing member can comprise a strap and can have one or more fasteners, such as Velcro-type fasteners, snaps, a buckle, buttons, or hooks and eyes.

The body of the wrist saver device can have a length at least as long as a maximum span of the palm of the user's hand and can comprises an elastomeric body and/or a foam body. In the illustrative embodiment, the body has a curved top. The bottom surface of the body of the wrist saver can be generally planar or flat, or can have bumps or dimples or can comprise a textured surface.

In one embodiment, the body of the wrist saver device has a longitudinal opening that provides an elongated hole or slot for receiving part of the securing member. In another embodiment, part of the securing member is positioned in proximity to the bottom surface of the body of the wrist saver device.

The unique wrist saver device provides comfort and support to the wrists and is designed to decrease stress in the user's wrist joints. Advantageously, the wrist saver device lessens extreme extension of the wrist by elevating the heel of the hand and thereby making exercises much more comfortable. The wrist saver devices not only lessen the degree of wrist extension, but also provide more comfort and less wrist strain.

Wrist saver devices can also help persons recover from carpal tunnel surgery or suffering from carnal tunnel syndrome.

Wrist saver devices are an exciting innovation for yoga enthusiasts and utilize an unimposing prop and accessory to make a healthy regimen more comfortable and effective. Many more people can now do pushups and hold yoga poses and positions with the help of the wrist saver devices without their wrist giving out.

Fortunately, a careful and gradual approach to increasing wrist flexibility and strength with the wrist saver devices can help most yoga enthusiasts and other exercisers avoid wrist problem and significant wrist pain.

The wrist is a complicated structure and can develop many problems other than the soreness that comes from unaccustomed extensions. If a person has more serious wrist problems, such as from carpal tunnel syndrome, arthritis, or previous fracture or surgery sites that are still stiff and painful, the wrist saver device can be helpful but a physician or other health care provider should be consulted before attempting yoga poses and other weight-bearing exercises.

A more detailed explanation of the invention is provided in the following detailed descriptions and appended claims taken in conjunction with the accompanying drawings.

DETAILED DESCRIPTION OF THE INVENTION

The following is a detailed description and explanation of the preferred embodiments of the invention and best modes for practicing the invention.

Figure 2:
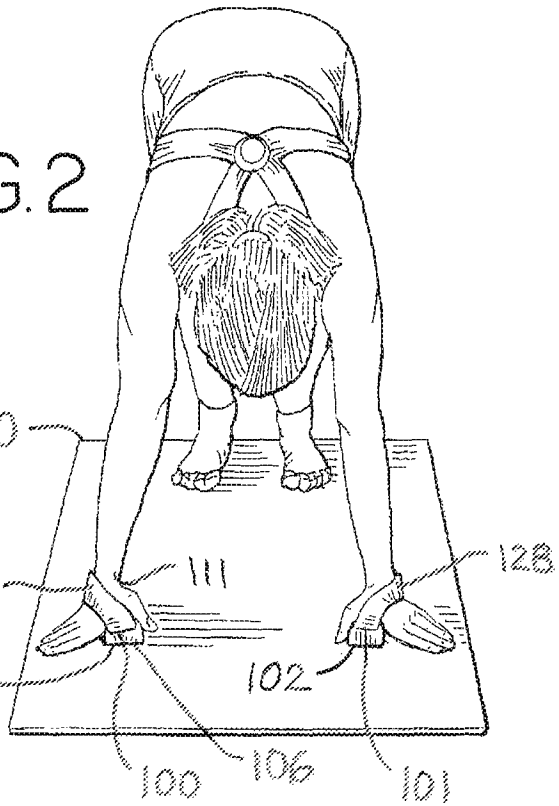
FIG. 2 is a perspective view of the person using the yoga wrist saver devices in another yoga pose, such as a downward facing dog pose or radho mukha svanasana.
Figure 1:
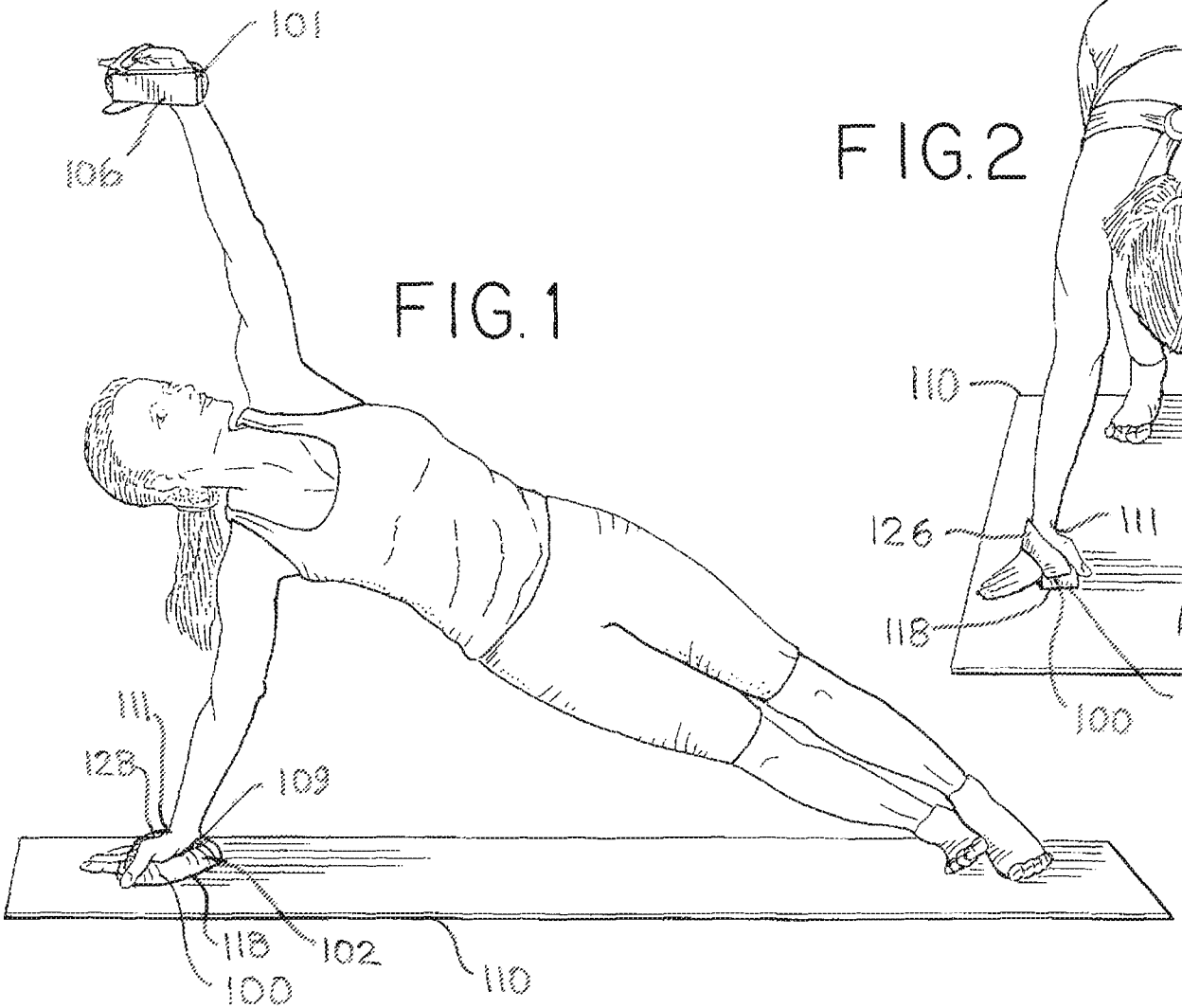
FIG. 1 is a perspective view of a person using yoga wrist saver devices in a yoga pose, such as a side plank pose or vasisthasana in accordance with principles of the present invention.

As shown in FIGS. 1-2, yoga wrist saver devices 100 and 101 provides sports accessories, props, exercise devices, assemblies and equipment for use in yoga, pushups, hand strands, dips and other upper body weight bearing exercises and especially upper body weight bearing floor exercises. The yoga wrist savers can comprise left hand and right hand wrist saver devices which can be identical or similar in size, shape, and weight or can be symmetrical and complementary to each other and be mirror images of each other.

Figure 3:
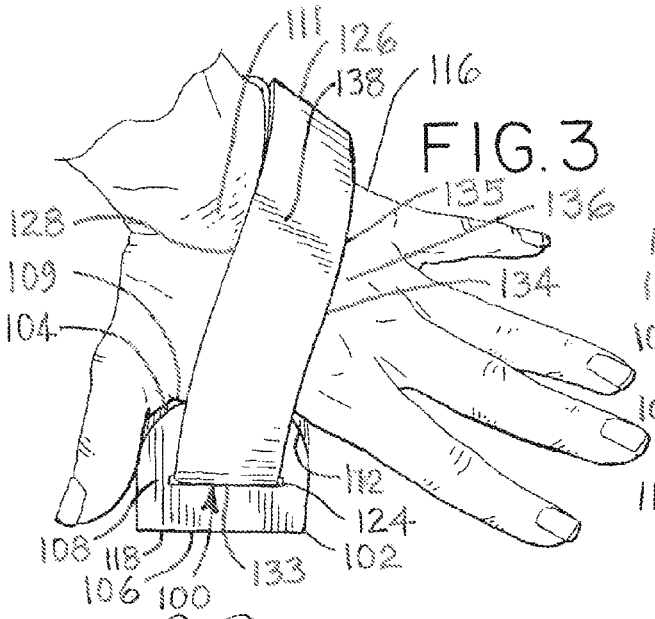
FIG. 3 is a right side end view of a yoga wrist saver device securely strapped about the person's hand.
Figure 4:
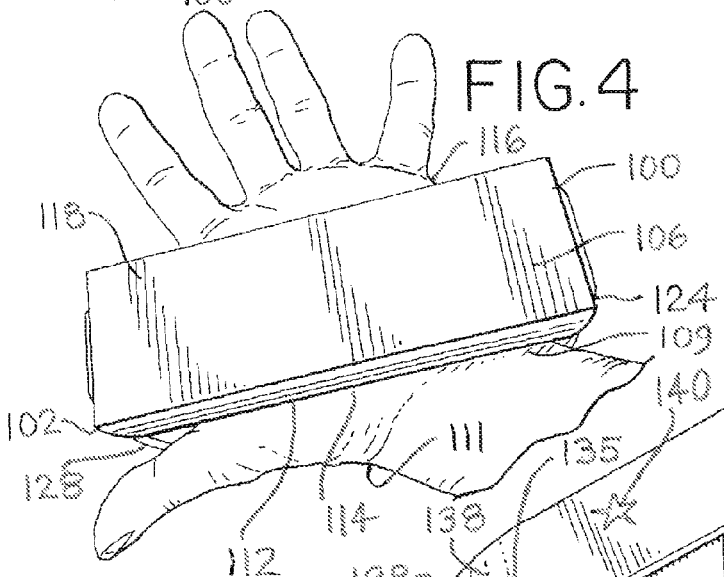
FIG. 4 is a bottom perspective view of the yoga wrist saver device positioned against the palm of the person's hand.

Each wrist saver device can comprise an elongated elastomeric foam, resilient, flexible compressible body 102 (FIGS. 3-5) having a curved top 104, a bottom 106, and an intermediate section 108 disposed between the top and bottom. The body can comprise thickly padded supportive foam for positioning under the heel of the user's hand so as to provide comfort and support during upper body weight bearing exercises. The height and thickness of the foam body should be sufficient to lift up the heel 109 of the user's hand above a support surface 110 (FIGS. 1 and 2), such as a mat, floor, ground or other surface to minimize extreme wrist extension and position the user's wrist 111 out of 90 degrees and preferably at an obtuse or oblique angle relative to the user's forearm and hand as well as to the mat, floor, ground or other support surface. The wrist saver design is designed to elevate the palm of the user's hand to prevent the user's hand from being completely flat to and against the mat, floor, ground or other support surface and prevent the user's wrist from making a 90 right angle between the forearm and hand. The body of the wrist saver device can comprise and be formed or made of silicone rubber, polyurethaneor ethylene vinyl acetate (EVA). Closed cell EVA is preferred because it is light weight, comfortable and accommodates an appropriate amount of compression. In some circumstances, it may be desirable to use other materials.

Figure 5:
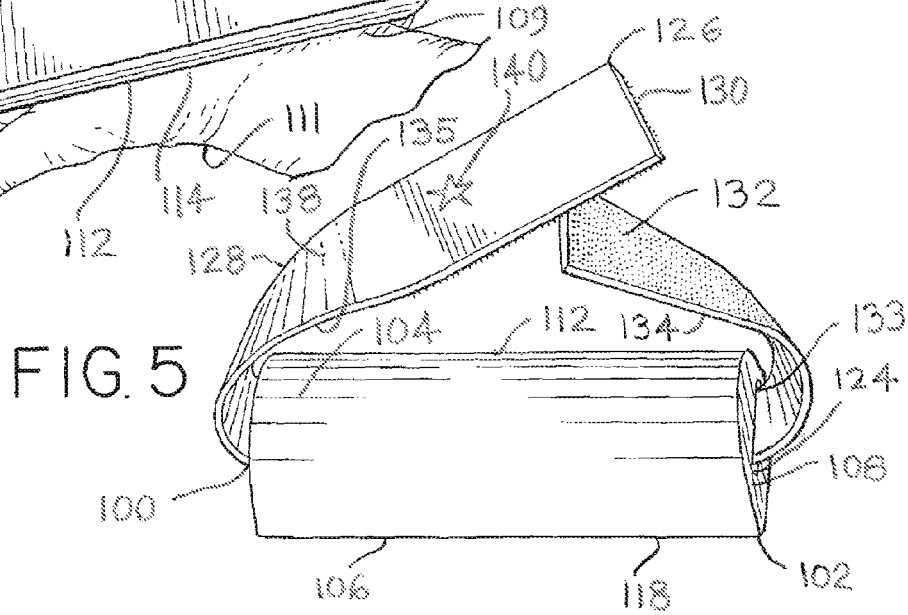
FIG. 5 is a front perspective view of the yoga wrist saver device with the strap in an open position.

The elongated compressible body of the wrist saver device is moveable from a normally expanded position, such as shown in the upper portion of FIG. 1 and in FIG. 5, before engaging a support surface 110, such as mat, floor, ground or other surface or when in storage, and is movable to compressed position when the body of the wrist saver device is pressed against and engages a mat, floor, ground or other support surface, such as shown in FIG. 2 and in the lower left portion of FIG. 1.

Figure 6:
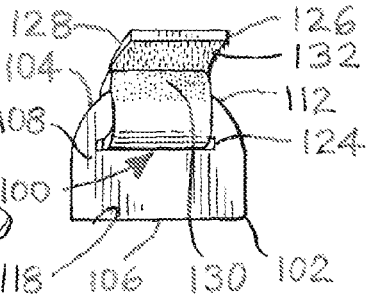
FIG. 6 is a left side end view of the yoga wrist saver device with a strap and a Velcro-type fastener.

The curved top of the body of the wrist saver device can comprise a convex palm-facing and palm-engaging surface 112 (FIGS. 3, 5, and 6) for engaging, cushioning, supporting and lifting a palm 114 of a user's hand 116 when the elongated compressible body is in the compressed position. Furthermore, the curved top of the body of the wrist saver device can have a length substantially greater than a maximum span (width) of the palm of the user's hand.

Figure 8:
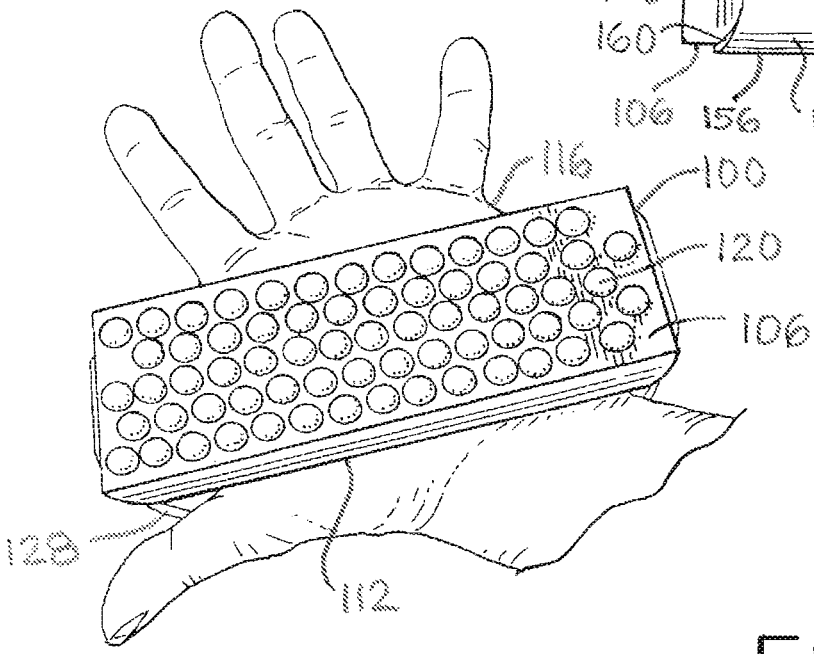
FIG. 8 is a bottom perspective view of a yoga wrist saver device with bumps providing dimples or protuberances on the bottom of the yoga wrist saver device in accordance with principles of the present invention.
Figure 9:
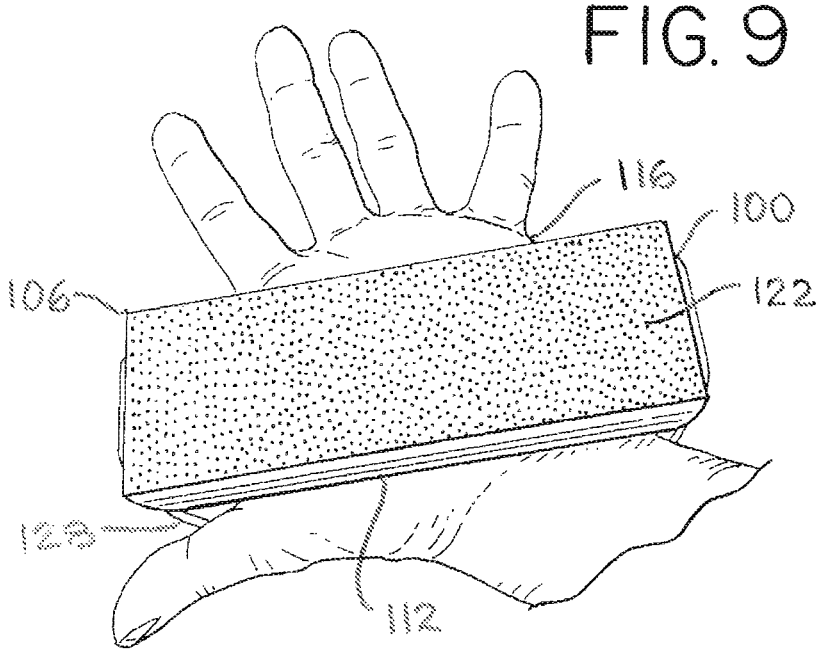
FIG. 9 is a bottom perspective view of a yoga wrist saver device with a textured bottom surface in accordance with principles of the present invention.

The bottom of the body of the wrist saver device can have a generally planar (flat) slip-resistant surface 118 (FIGS. 1-6) for facing and engaging a mat, floor, ground or other support surface with minimal or no slipping or sliding when the elongated body of the wrist saver device is in the compressed position. In some circumstances, it may be desirable to have bumps 120 (FIG. 8) providing dimples or protuberances that extend outwardly or downwardly from the bottom surface of the body of the wrist saver device. In other circumstances, it may be desirable that the bottom surface comprise a textured bottom surface 122 (FIG. 9). The bumps or textured bottom surface can further minimize slipping and sliding of the bottom of the wrist saver device when the wrist saver device is pressed against a mat, floor, ground or other support surface.

The intermediate section of the body of the wrist saver device can have an elongated longitudinal strap-receiving opening 124 (FIGS. 5 and 6) which provides and defines an elongated slot or hole that extends lengthwise through the intermediate section.

A securing member 126 (FIGS. 3, 5 and 6) of the wrist saver device can comprise at least one adjustable elongated strap 128 with one or more fasteners 130, such as Velcro-type fasteners 132 for securing the convex surface of the curved top against the palm of the user's hand. The strap can comprise a stretchable elastic strap and preferably comprises a nylon or nylon-type material (polyamides). If desired, the securing member can comprise other materials.

The strap can have a slot-engaging portion 133 (FIGS. 3, 5 and 6) for engaging and insertion in the opening or slot of the intermediate section of the body of the wrist saver device. Preferably, the strap comprises a length ranging from 2 to 3 times a maximum length of the intermediate section of the body of the wrist saver device. The strap can have an inner hand-engaging strap portion 134 (FIGS. 3 and 5) that provides an underside 135 for firmly engaging the back 136 of a user's hand at a location generally opposite the convex surface of the top of the body of the wrist saver device. The strap can also have an outer strap portion 138 that is positioned generally opposite the inner strap portion and faces outwardly.

The outer strap portion can have indicia 140 (FIG. 5) sewn, bonded, glued or otherwise secured thereon. The indicia can comprise text, a logo, alpha numeric lettering, numbers, art work, designs, symbols, decorations, color graphics, black graphics, characters, images, or combination of any of the preceding.

Advantageously, the body and the securing member of the wrist saver device cooperate with each other for decreasing stress and strain of a user's wrist joint by elevating a heel of a user's hand and lessening the amount and degree of an extension of a user's wrist so as to comfort and cushion the user's wrist and substantially prevent the user's wrist from being positioned at a 90 degree right angle and perpendicular to the user's forearm and hand when the elongated body of the wrist saver device is in the compressed position.

Figures 10, 11, 12, 13:
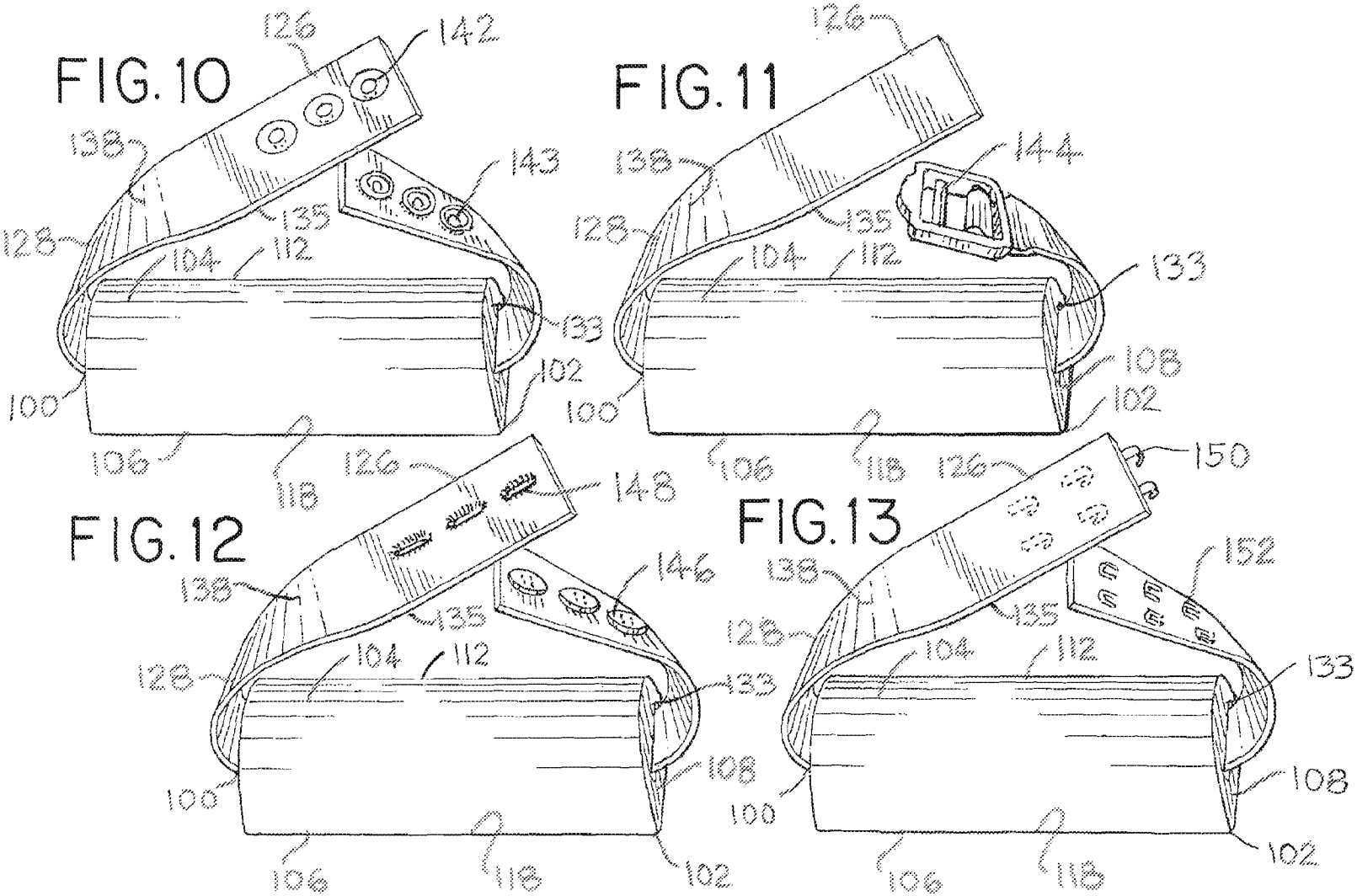
FIG. 10 is a front perspective view of a yoga wrist saver device with a strap and snaps in an open position in accordance with principles of the present invention.
FIG. 11 is a front perspective view of a yoga wrist saver device with a strap and a buckle in an open position in accordance with principles of the present invention.
FIG. 12 is a front perspective view of a yoga wrist saver device with a strap and buttons in an open position in accordance with principles of the present invention.
FIG. 13 is a front perspective view of a yoga wrist saver device with a strap and hooks in an open position and eyes in accordance with principles of the present invention.

While Velcro-type fasteners are preferred for ease of use, in some circumstances it may be desirable to use other fasteners, such as snaps 142 and 143 (FIG. 10) a buckle 144 (FIG. 11), buttons 146 with button holes 148 (FIG. 12), or one or more hooks 150 and eyes 152 (FIG. 13).

In one preferred embodiment, the strap was 18.5 inches long and 1.25 inches wide. The body was 5.5 inches long, 2 inches wide and 1.5 inches high. Wrist saver devices with other dimensions can be used.

Figure 7:
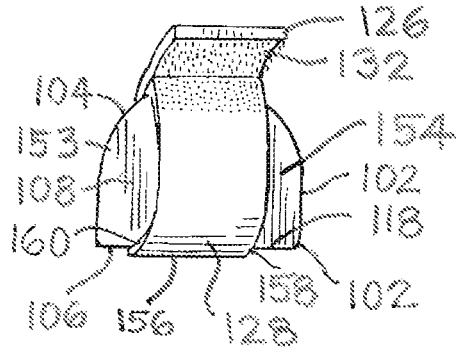
FIG. 7 is a left side end view of another yoga wrist saver device with a strap and a Velcro-type fastener in accordance with principles of the present invention.

In some circumstances, it may be desirable that the intermediate section of the body of the wrist saver device 153 (FIG. 7) comprise a solid, imperforate or impervious section 154 without an elongated opening (hole) and that the lower strap portion 156 is positioned in proximity to the bottom of the body of the wrist saver device. Velcro-type fasteners 158 and 160 can be used for securing the lower strap portion to the bottom of the body of the wrist saver device.

The wrist saver device can have a body made from a closed cell EVA foam or similar cushioning and supportive materials. The body of the wrist saver device can be tubular, cylindrical shaped, semi-cylindrical or arch shaped with the bottom being flat. Furthermore, the wrist saver device can have a strap which attaches to the cushion body that facilitates wearing the wrist saver device on or about the user's hand. The strap goes under or through the cylinder body and over the backside of the user's hand keeping the hand attached to the foam body.

When the wrist saver device is strapped to a user's hand, the palm of the user's hand can rest on the foam body of the wrist saver device during weight bearing exercises. Specifically, the palmers' metacarpal heads can rest on the wrist saver device.

The strap can be made with elastic and fastened with a Velcro-type fastener, a buckle, snap or any other closure fastener that allows it to be adjustable in length to accommodate different size hands.

The wrist saver device can provide a foam based, support with a flat under surface intended to elevate and support the wrist during weight bearing exercises. The wrist saver device can also have adjustable length strapping that affixes the foam based support (body) to the user's hand.

In use, the foam body of the wrist saver device can be positioned on the heel of the palm of the user's hand. The strap should then be adjusted and secured to the desired tension. The back of the hand and the four fingers of the user should go under the strap far enough so that the finger fully rest on the mat, floor, ground or other support surface to support the weight of the user's body. When the wrist saver device is positioned properly, the heel of the user's hand will be elevated, to prevent the user's hand from being positioned at 90 right degrees or perpendicular to the user's forearm and hand.

Among the many advantages of the unique wrist saver devices are:

1. Superior wrist comfort and support during upper body weight bearing exercises.
2. Superb capabilities for elevating the heel of the hand to eliminate the 90 degree right angle of the hand and forearm from the wrist and push the weight forward into the fingers away from the wrist.
3. Excellent ability to hold longer poses because of more comfort and less wrist strain.
4. Non-slip.
5. Less stress on the wrist joint and minimizes extreme extension of the wrist.
6. Outstanding performance.
7. Reliable.
8. Cushions the palm of the hand.
9. Light weight and virtually weightless for continuous wear during a yoga session.
10. Portable and readily transportable.
11. User friendly.
12. Easy to use.
13. One size fits all.
14. Durable.
15. Economical.
16. Attractive.
17. Efficient.
18. Effective.

Although embodiments of the invention have been shown and described, it is to be understood that various modifications, substitutions, and rearrangements of parts and components, as well as other uses and sizes of the wrist saver device, can be made by those skilled in the art without departing from the novel spirit and scope of this invention.

What is claimed is:

1. An exercise device that supports a body joint of a user above a support surface, the device comprising:
- a body formed of a resilient material and having a body length with a substantially constant cross-section throughout the body length, the body including:
  - a convex top surface that directly engages the user;
  - a substantially flat and substantially continuous bottom surface that directly contacts the support surface;
  - a pair of opposite end surfaces extending between the top surface and the bottom surface; and
- a securing member including:
  - a body-engaging portion coupled to the body; and
  - a user-engaging portion that engages the user.

2. The exercise device according to claim 1, wherein the body includes elastomeric foam.

3. The exercise device according to claim 1, wherein the bottom surface includes protrusions to inhibit sliding of the device relative to the surface during the exercise.

4. The exercise device according to claim 1, further comprising a slot extending through the body and the end surfaces and along the body length.

5. The exercise device according to claim 4, wherein the slot is substantially parallel to the bottom surface.

6. The exercise device according to claim 1, wherein the body is formed entirely of resilient material.

7. The exercise device according to claim 1, wherein a length of the securing member is 1-3 times the body length.

8. The exercise device according to claim 1, wherein the user-engaging portion includes:
- an inner user-engaging portion that engages the user and extends from one end of the body-engaging portion; and
- an outer strap portion that extends from an opposite end of the body-engaging portion and is attachable to the user-engaging portion to secure the body to the user.

9. The exercise device according to claim 8, wherein the outer strap portion is disposed outwardly of the inner strap portion when the device is secured to the user.

10. The exercise device according to claim 1, wherein the securing member is continuous along an entire length thereof.

11. An exercise device that supports a wrist of a user above a support surface, the device comprising:
- a body formed of a resilient material and having a body length with a substantially constant cross-section throughout the body length, the body including:
  - a convex top surface that directly engages the user at a location adjacent the wrist;
  - a bottom surface including a gripping portion that maintains the exercise device in a stationary position on the support surface during an exercise;
  - a pair of opposite end surfaces extending between the top surface and the bottom surface; and
- a securing member including:
  - a body-engaging portion coupled to the body;
  - an inner user-engaging portion that engages the user and extends from one end of a slot-engaging portion; and
  - an outer strap portion that extends from an opposite end of the slot-engaging portion and is attachable to the user-engaging portion to secure the body to the user.

12. The exercise device according to claim 11, wherein the body elevates the wrist with respect the non-thumb fingers of the user's hand when the non-thumb fingers are placed on the support surface.

* * * * *